US007493879B2

(12) United States Patent
Fujii et al.

(10) Patent No.: US 7,493,879 B2
(45) Date of Patent: Feb. 24, 2009

(54) ENGINE VALVE OPERATING SYSTEM

(75) Inventors: Noriaki Fujii, Wako (JP); Keiko Yoshida, Wako (JP); Tomoya Fujimoto, Wako (JP)

(73) Assignee: Honda Motor Co., Ltd., Minato-ku (JP)

( * ) Notice: Subject to any disclaimer, the term of this patent is extended or adjusted under 35 U.S.C. 154(b) by 57 days.

(21) Appl. No.: 10/586,962

(22) PCT Filed: Jan. 28, 2005

(86) PCT No.: PCT/JP2005/001193

§ 371 (c)(1),
(2), (4) Date: Jul. 25, 2006

(87) PCT Pub. No.: WO2005/073521

PCT Pub. Date: Aug. 11, 2005

(65) Prior Publication Data

US 2007/0157895 A1 Jul. 12, 2007

(30) Foreign Application Priority Data

Jan. 30, 2004 (JP) ..... 2004-023954

(51) Int. Cl.
*F01L 1/34* (2006.01)

(52) U.S. Cl. ..... 123/90.16; 123/90.15; 123/90.2; 123/90.39; 123/90.43

(58) Field of Classification Search ..... 123/90.16, 123/90.43
See application file for complete search history.

(56) References Cited

U.S. PATENT DOCUMENTS 4,399,787 A * 8/1983 Cavanagh ..... 123/321

(Continued)

FOREIGN PATENT DOCUMENTS

GB 2 138 093 10/1984

(Continued)

OTHER PUBLICATIONS

Supplementary European Search Report mailed Nov. 7, 2008 in corresponding application; 2 pages.

*Primary Examiner*—Thomas E Denion
*Assistant Examiner*—Kyle M Riddle
(74) *Attorney, Agent, or Firm*—Kratz, Quintos & Hanson, LLP

(57) ABSTRACT

An engine valve operating system is provided in which a rocker arm that swings by following a valve operating cam abuts against an engine valve via a hydraulic tappet, a receiving member (41) receiving the hydraulic tappet (12) being slidably fitted into the rocker arm (13), the hydraulic tappet (12) being fitted into the rocker arm (13), a restricting part (29) being provided so as to face the receiving member (41) from the side opposite to the hydraulic tappet (12), and an adjustment screw (44) for adjusting a clearance between the restricting part (29) and the receiving member (41) when the engine valve is in a valve-closed state being screwed into an engine main body (5) so that its position can be adjusted back-and-forth so as to abut against the receiving member (41) when the engine valve is closed. This enables the amount of lift of the engine valve to easily be adjusted with good precision while eliminating the need for complicated machining or production control when opening or closing the engine valve via the hydraulic tappet by means of the rocker arm.

2 Claims, 4 Drawing Sheets

U.S. PATENT DOCUMENTS

| | | | | |
|---|---|---|---|---|
| 4,475,500 | A * | 10/1984 | Bostelman | 123/321 |
| 4,815,424 | A | 3/1989 | Buuck et al. | 123/90.46 |
| 4,924,821 | A | 5/1990 | Teerman | 123/90.22 |
| 5,857,438 | A * | 1/1999 | Barnard | 123/90.16 |
| 6,354,254 | B1 * | 3/2002 | Usko | 123/90.16 |
| 6,422,186 | B1 * | 7/2002 | Vanderpoel | 123/90.15 |
| 6,925,976 | B2 * | 8/2005 | Israel et al. | 123/90.12 |

FOREIGN PATENT DOCUMENTS

| | | |
|---|---|---|
| JP | 59-170413 | 9/1984 |
| JP | 6-264708 | 9/1994 |
| JP | 2001-98912 | 4/2001 |
| JP | 2004-36560 | 2/2004 |
| JP | 2004-353599 | 12/2004 |
| WO | WO 01/18373 | 3/2001 |

* cited by examiner

ENGINE VALVE OPERATING SYSTEM

TECHNICAL FIELD

The present invention relates to an engine valve operating system in which a rocker arm that swings by following a valve operating cam abuts against an engine valve via a hydraulic tappet.

BACKGROUND ART

A valve operating system in which a hydraulic tappet abutting against an engine valve is provided on a rocker arm is already known from Patent Publication 1, etc.

Patent Publication 1: Japanese Patent Application Laid-open No. 6-264708

DISCLOSURE OF INVENTION

Problems to be Solved by the Invention

In the conventional valve operating system in which the hydraulic tappet is provided on the rocker arm, a tappet clearance is maintained at '0' by absorbing wear or changes in temperature, but since production errors, assembly errors, etc. of each part of the valve operating system remain unchanged, this results in a variation in the amount of lift of the engine valve. Furthermore, there is a possibility that when dynamic fluctuations occur in a camshaft on which a valve operating cam is provided, the engine valve might be pushed by the hydraulic tappet; in order to eliminate such pushing, conventionally, the radius of the base circle of the valve operating cam is gradually changed along the peripheral direction, or the initial amount of fall of the hydraulic tappet is controlled, but there are the problems that machining and production control is difficult, and there are variations between individuals in the way they operate.

The present invention has been accomplished under the above-mentioned circumstances, and it is an object thereof to provide an engine valve operating system in which, when opening or closing an engine valve via a hydraulic tappet by means of a rocker arm, the amount of lift of the engine valve can easily be adjusted with good precision while eliminating the need for complicated machining or production control.

Means for Solving Problems

In order to attain the above object, in accordance with a first aspect of the present invention, there is provided an engine valve operating system in which a rocker arm that swings by following a valve operating cam abuts against an engine valve via a hydraulic tappet, characterized in that a receiving member receiving the hydraulic tappet is slidably fitted into the rocker arm, the hydraulic tappet being fitted into the rocker arm, a restricting part is provided so as to face the receiving member from the side opposite to the hydraulic tappet, and an adjustment screw for adjusting a clearance between the restricting part and the receiving member when the engine valve is in a valve-closed state is screwed into an engine main body so that the position of the adjustment screw can be adjusted back-and-forth so as to abut against the receiving member when the engine valve is closed.

In accordance with a second aspect of the present invention, in addition to the arrangement of the first aspect, there is provided an engine valve operating system, wherein a screw retaining part having the adjustment screw screwed thereinto is provided on a cam holder provided on the engine main body so as to rotatably support a camshaft having the valve operating cam provided thereon.

In accordance with a third aspect of the present invention, in addition to the arrangement of the first aspect, there is provided an engine valve operating system, wherein the system comprises a variable lift mechanism that makes the amount of lift of the engine valve steplessly variable.

In accordance with a fourth aspect of the present invention, in addition to the arrangement of the third aspect, there is provided an engine valve operating system, wherein the variable lift mechanism comprises a first link arm having one end part pivotably connected to the rocker arm and the other end part pivotably supported at a fixed position of the engine main body via a fixed support shaft, and a second link arm having one end part pivotably connected to the rocker arm and the other end part pivotably supported by a movable support shaft that is capable of changing position, a cylindrical boss projecting on the side opposite to the rocker arm so as to surround a connecting shaft is provided integrally with the one end part of the first link arm, the first link arm being in sliding contact with a side face of the rocker arm and pivotably connected to the rocker arm via the connecting shaft, an oil path forming member having a mating hole with the boss fitted thereinto is mounted on the rocker arm so as to be in intimate contact with the side face of the rocker arm at a position offset from a sliding contact area of the one end part of the first link arm with the rocker arm, a first oil path communicating with an oil supply path provided coaxially within the fixed support shaft is provided in the first link arm, an annular second oil path communicating with the first oil path is formed between the boss of the first link arm and the connecting shaft, a third oil path communicating with the second oil path is provided in the oil path forming member, and a fourth oil path providing communication between the third oil path and the hydraulic tappet is provided in the rocker arm.

EFFECTS OF THE INVENTION

In accordance with the first aspect of the present invention, if there is a clearance between the restricting part of the rocker arm and the receiving member when the engine valve is in the valve-closed state, since a force from the hydraulic tappet to the engine valve in a valve-opening direction does not act until the restricting part abuts against the receiving member after swinging of the rocker arm in the valve-opening direction has started, it is possible, by adjusting the clearance between the restricting part and the receiving member by determining the back-and-forth position of the adjustment screw abutting against the receiving member when the engine valve is in a valve-closed state, to easily adjust the amount of lift of the engine valve with good precision so that there is no variation in the amount of lift of the engine valve even if there are production errors, assembly errors, etc. in each part of the valve operating system. Moreover, when there are dynamic fluctuations in the camshaft, even if the rocker arm swings by a degree corresponding to the clearance between the restricting part and the receiving member, the engine valve is not pushed by the hydraulic tappet, and it is possible to prevent the hydraulic tappet from pushing the engine valve while eliminating the need for complicated machining or production control.

Furthermore, in accordance with the second aspect of the present invention, since the screw retaining part having the adjustment screw screwed thereinto is provided on the cam holder, which has relatively high rigidity so as to support the camshaft, the rigidity with which the adjustment screw is supported can be increased.

In accordance with the third aspect of the present invention, even when the amount of lift of the engine valve is made very small by the variable lift mechanism, the very small amount of lift can be achieved with good precision, which is advantageous for the valve operating system having the variable lift mechanism.

Moreover, in accordance with the fourth aspect of the present invention, since the parts at one end of the first and second link arms are pivotably connected directly to the rocker arm so that the amount of lift of the engine valve is steplessly variable by steplessly changing the position of the movable support shaft, the space in which the two link arms are disposed can be reduced and the valve operating system can be made compact, and since the power from the valve operating cam is transmitted directly to the cam abutment portion of the rocker arm, it is possible to ensure that the ability to follow the valve operating cam is excellent. Furthermore, the first link arm pivots around the axis of the fixed support shaft, it is easy to make the oil supply path within the fixed support shaft communicate with the first oil path within the first link while reducing any leakage, it is also easy to form the second oil path communicating with the first oil path while reducing any leakage between the boss of the first link arm and the connecting shaft, to make the third oil path, which is provided in the oil path forming member pivoting around the axis of the connecting shaft relative to the boss, communicate with the second oil path while reducing any leakage, and to make the fourth oil path, which is provided on the rocker arm and communicates with the hydraulic tappet, communicate with the third oil path of the oil path forming member swinging together with the rocker arm while reducing any leakage, it is possible to reliably supply oil from the fixed support shaft to the hydraulic tappet by a simple oil path arrangement and, moreover, it is possible to provide lubrication between the first link arm and the connecting shaft with oil in the second oil path.

EXPLANATION OF REFERENCE NUMERALS AND SYMBOLS

5 Engine Main Body
7 Intake Valve as Engine Valve
11 Valve Operating Cam
12 Hydraulic Tappet
13 Rocker Arm
14 Camshaft
15 Cam Holder
18 Variable Lift Mechanism
19 First Link Arm
20 Second Link Arm
21 Fixed Support Shaft
24 Connecting Shaft
29 Restricting Part
41 Receiving Member
44 Adjustment Screw
45 Screw Retaining Part
46 Oil Supply Path
47 Boss
48 Oil Path Forming Member
50 Mating Hole
52 First Oil Path
53 Second Oil Path
54 Third Oil Path
55 Fourth Oil Path

Best Mode for Carrying out the Invention

Modes for carrying out the present invention are explained below by reference to an embodiment of the present invention shown in the attached drawings.

Embodiment 1

FIG. 1 to FIG. 4 show one embodiment of the present invention.

Figure 1:
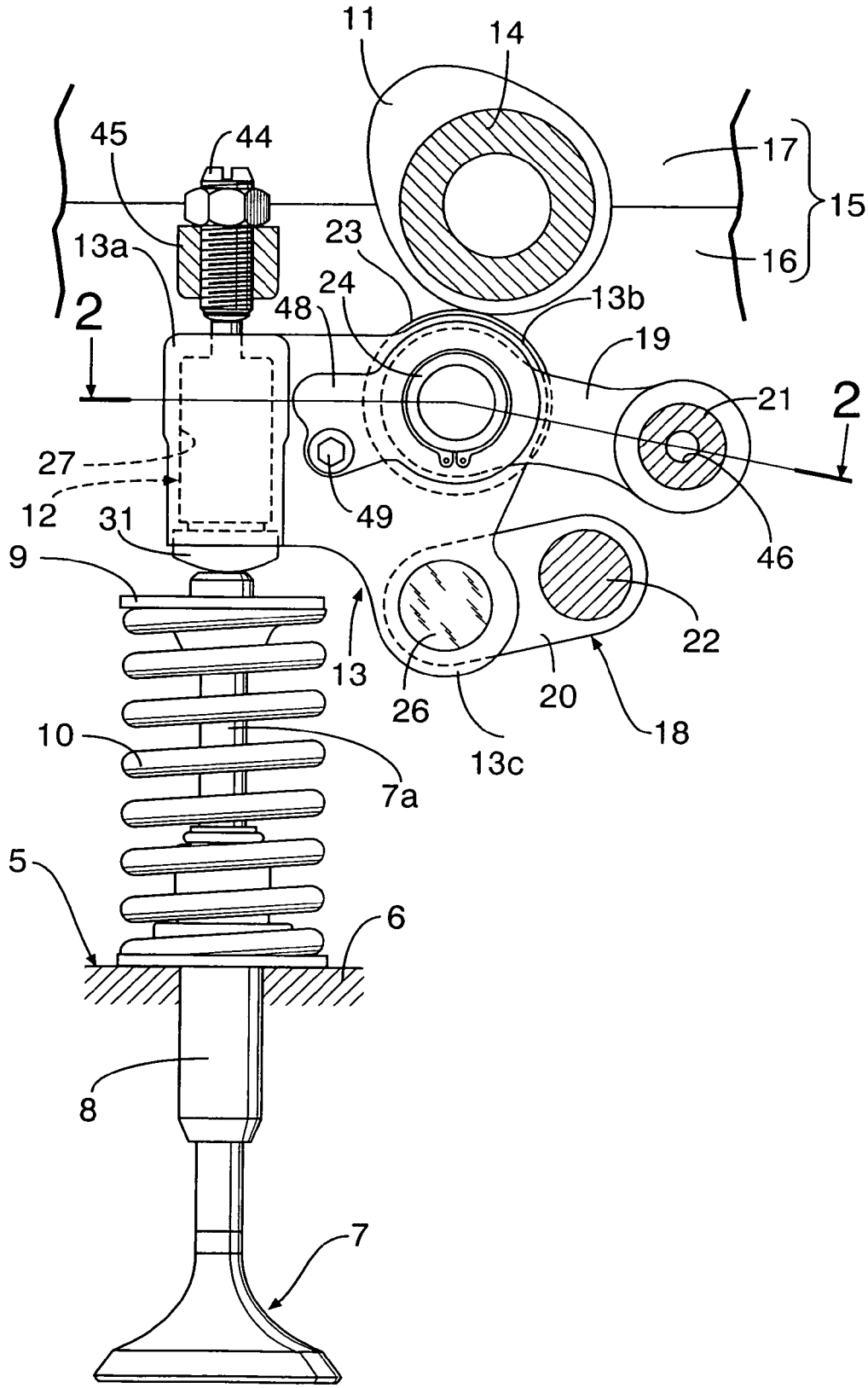
FIG. 1 A partial vertical sectional view of an engine (first embodiment).
Figure 2:
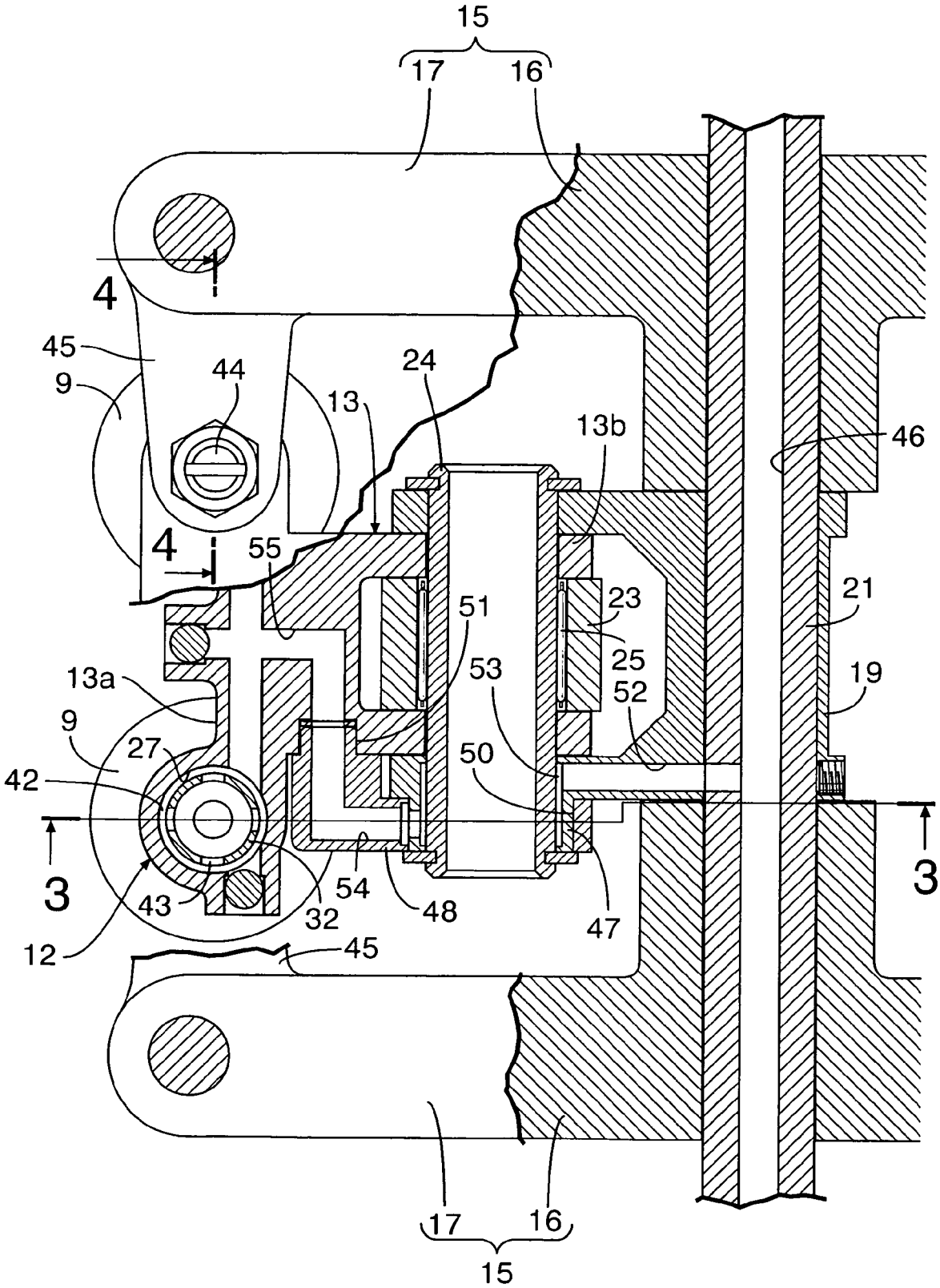
FIG. 2 A sectional view along line in 2-2 in FIG. 1 (first embodiment).

Referring first to FIG. 1, a cylinder head 6 of an engine main body 5 of an engine is provided with guide tubes 8 allowing stems 7*a* of a pair of intake valves 7, which are engine valves, to be fitted slidably thereinto in order to guide opening/closing of the intake valves 7, and valve springs 10 for urging the intake valves 7 in a valve-closing direction are provided between the cylinder head 6 and retainers 9 fixed to upper parts of the stems 7*a* projecting from the guide tubes 8.

The valve operating system for opening/closing the intake valves 7 includes a rocker arm 13 that swings by following a valve operating cam 11 and abuts against the engine valves 7 via hydraulic tappets 12, the valve operating cam 11 being provided on a camshaft 14. An upper holder 17 forming a cam holder 15 together with a lower holder 16 is connected from above to the holder 16, which is provided on the cylinder head 6, and the camshaft 14 is rotatably supported by the cam holder 15 while being sandwiched between the upper and lower holders 16 and 17.

This valve operating system is equipped with a variable lift mechanism 18 that is capable of steplessly changing the amount of lift of the engine valve 6, and the variable lift mechanism 18 includes a first link arm 19, a fixed support shaft 21, a second link arm 20, and a movable support shaft 22, the first link arm 19 having one end part pivotably connected to one end part of the rocker arm 13, which has the hydraulic tappets 12 mounted on the other end part, the fixed support shaft 21 pivotably supporting the other end part of the first link arm 19 at a fixed position of the engine main body 5, the second link arm 20 being disposed beneath the first link arm 19 and having one end part pivotably connected to said one end part of the rocker arm 13, and the movable support shaft 22 pivotably supporting the other end part of the second link arm 20.

A valve connecting portion 13*a* is provided on said other end part of the rocker arm 13, the hydraulic tappets 12 being mounted on the valve connecting portion 13*a* and abutting against the upper ends of the stems 7*a* of the pair of intake valves 7 from above. Furthermore, a first support portion 13*b* and a second support portion 13*c*, which is disposed beneath the first support portion 13*b*, are provided so as to be joined to each other on said one end part of the rocker arm 13, the first and second support portions 13*b* and 13*c* having a substantially U-shaped form opening on the side opposite to the intake valves 7.

A roller 23 that is in rolling contact with the valve operating cam 11 of the camshaft 14 is axially supported on the first support portion 13*b* of the rocker arm 13 via a first connecting shaft 24 and a roller bearing 25, and the roller 23 is disposed so as to be sandwiched by the substantially U-shaped first support portion 31*b*.

Said one end part of the first link arm 19 has a substantially U-shaped form so as to sandwich the first support portion 13*b* of the rocker arm 13 from opposite sides, and is pivotably connected to the first support portion 13*b* via the first connecting shaft 24, which axially supports the roller 23 on the rocker arm 13. That is, pivotable connection of said one end part of the first link arm 19 to the rocker arm 13 and axial support of the roller 23 on the rocker arm 13 can be achieved in common by the first connecting shaft 24, thereby decreasing the number of components as well as contributing to making the valve operating system compact.

A support boss 16*a* projecting toward the first link arm 19 side is projectingly provided on each of the lower holders 16 of the cam holders 15 on either side of said other end part of the first link arm 19, said other end part of the first link arm 19 is pivotably supported by the fixed support shaft 21, which is supported by the lower holders 16 so as to run though the support bosses 16*a*, and movement of the first link arm 19 in a direction along the axis of the fixed support shaft 21 is restricted by the two support bosses 16*a*.

One end part of the second link arm 20, which is disposed beneath the first link arm 19, is disposed so as to be sandwiched by the second support portion 13*c* of the rocker arm 13, and is pivotably connected to the second support portion 13*c* via a second connecting shaft 26.

In this variable lift mechanism 18, the position of the movable support shaft 22 is steplessly changed by drive means (not illustrated), and the amount of lift of the intake valves 7 changes steplessly according to a change in the position of the movable support shaft 22.

Figure 3:
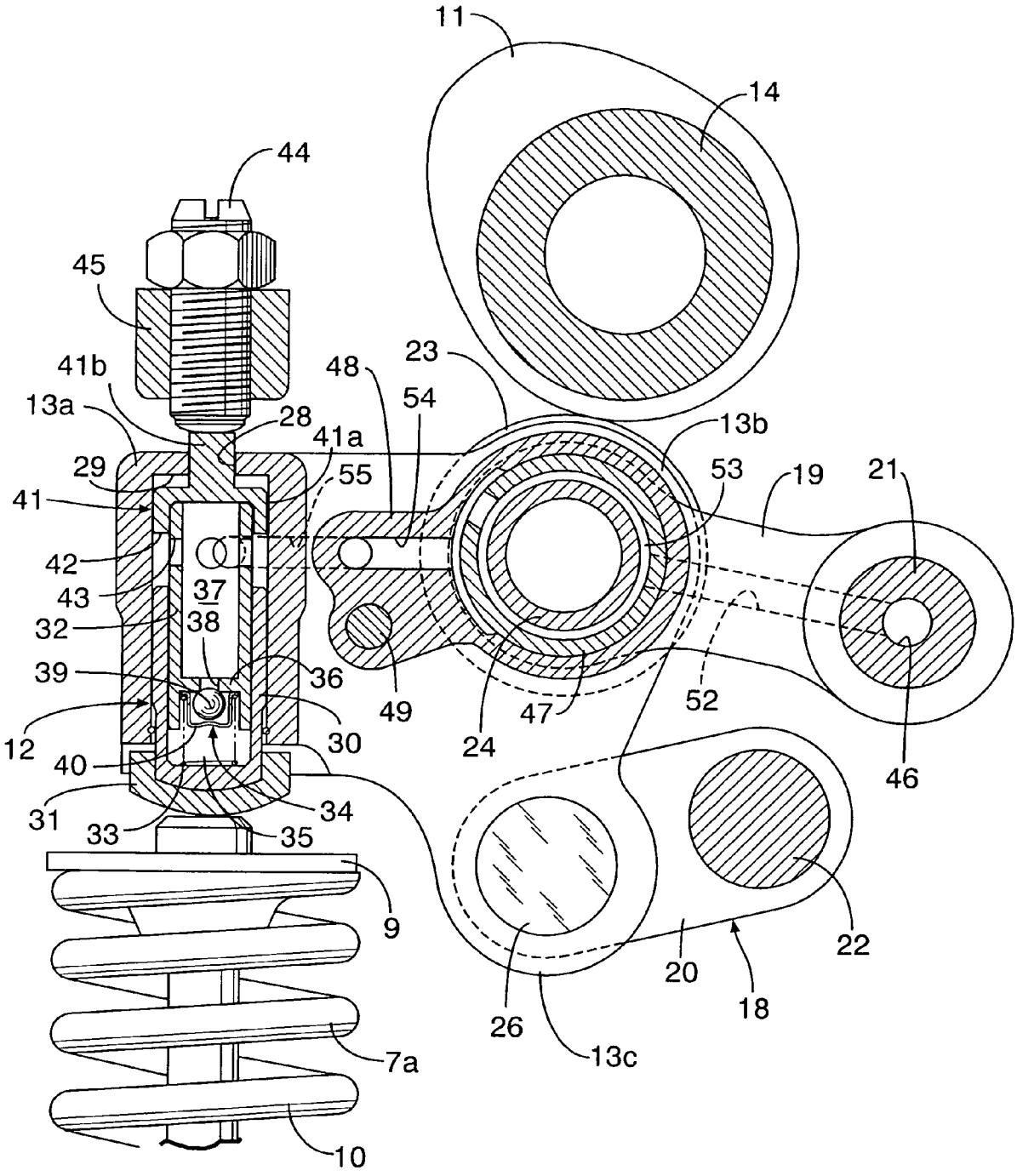
FIG. 3 A sectional view along line 3-3 in FIG. 2 (first embodiment).
Figure 4:
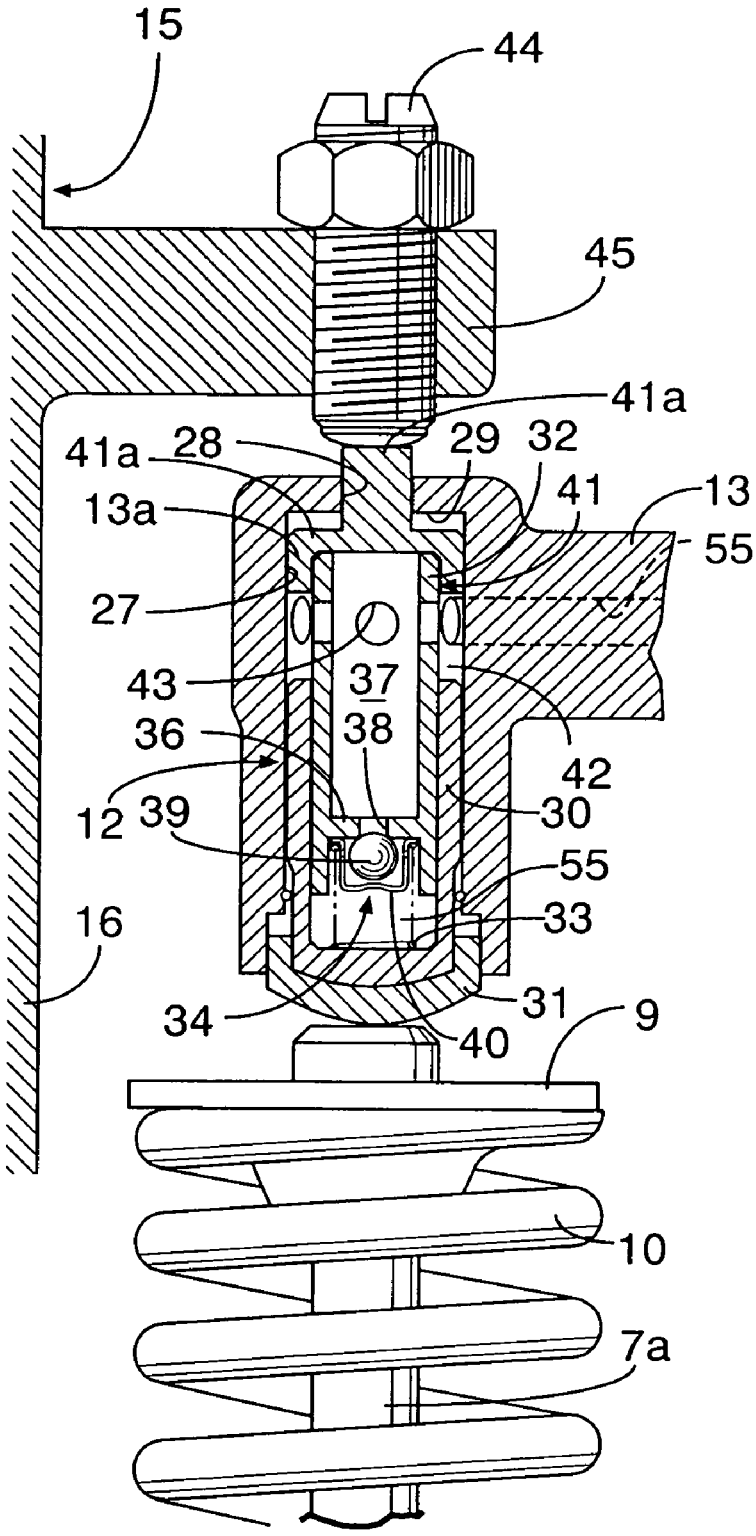
FIG. 4 A sectional view along line 4-4 in FIG. 2 (first embodiment).

In FIG. 3 and FIG. 4, bottomed mounting holes 27 having a closed upper end are provided on either side of the valve connecting portion 13*a* of the rocker arm 13, through holes 28 are bored in central areas of the closed ends of the mounting holes 27, and inner faces of the closed ends around the through holes 28 function as annular restricting parts 29.

The hydraulic tappet 12 includes a plunger 30 that has a bottomed cylindrical shape with a closed lower end and is slidably fitted into the mounting hole 27, a cap-shaped tip 31 that is mounted so as to cover the closed part at the lower end of the plunger 30 and has a portion slidably fitted into a lower portion of the slide hole 27, a cylindrical member 32 that is relatively slidably fitted into the plunger 30, a return spring 33 that is provided in a compressed state between the plunger 30 and the cylindrical member 32, and a check valve 34.

Provided integrally with a portion close to the lower end of the cylindrical member 32 is a dividing wall 36 forming a hydraulic chamber 35 between itself and the closed part at the lower end of the plunger 30, the dividing wall 36 separating an oil reservoir chamber 37 formed within the cylindrical member 32 above the dividing wall 36 from the hydraulic chamber 35, and the return spring 33 being provided between the lower closed end of the plunger 30 and the dividing wall 36.

The check valve 34 is formed by housing a spherical valve body 39 in a floating state within a cage 40 housed within the hydraulic chamber 36 so as to be pressed toward the dividing wall 36 side by means of the return spring 33, the spherical valve body 39 being capable of closing, from the hydraulic chamber 35 side, a valve hole 38 that is bored in a central area of the dividing wall 36 so as to provide communication between the oil reservoir chamber 37 and the hydraulic chamber 35; when the cylindrical member 32 moves upward relative to the plunger 30 so as to increase the capacity of the hydraulic chamber 35, the check valve 34 opens so as to allow oil to return from the hydraulic chamber 35 to the oil reservoir chamber 37 side.

This hydraulic tappet 12 is received by a receiving member 41 slidably fitted into the mounting hole 27 on the inside of the hydraulic tappet 12; this receiving member 41 includes a bottomed cylindrical portion 41*a* and a shaft portion 41*b*, the bottomed cylindrical portion 41*a* being slidably fitted into the mounting hole 27 so that the upper end of the cylindrical member 32 abuts against the closed end of the cylindrical portion 41*a*, and the shaft portion 41*b* being coaxially and integrally provided on a central area of the bottomed cylindrical portion 41*a* so as to run movably through the through hole 28.

An annular passage 42 is formed within the mounting hole 27 between the bottomed cylindrical portion 41*a* of the receiving member 41 and the upper end of the plunger 30, and a plurality of communication holes 43 providing communication between the annular passage 42 and the oil reservoir chamber 37 are provided in the cylindrical member 32.

When the intake valve 7 closes, an adjustment screw 44 abuts against the upper end of the shaft portion 41*b*, delivered upward from the through hole 28, of the receiving member 41. The adjustment screw 44 is screwed into the engine main body 5 so that its position can be adjusted back-and-forth; when the intake valve 7 is in a valve-closed state the adjustment screw 44 adjusts the clearance between the bottomed cylindrical portion 41*a* of the receiving member 41 and the restricting part 29 provided at the closed end of the mounting hole 27 provided so as to face the bottomed cylindrical portion 41*a* of the receiving member 41 from the side opposite to the hydraulic tappet 12.

Moreover, a screw retaining part 45 is provided on the lower holder 16 of the cam holder 15 provided on the engine main body 5 so as to rotatably support the camshaft 14, and the adjustment screw 4 is screwed into the screw retaining part 45.

In order to supply oil to the hydraulic tappets 12, an oil supply path 46 communicating with an oil supply source (not illustrated) is provided within the fixed support shaft 21, a cylindrical boss 47 is integrally provided laterally to one side of said one end part of the first link arm 19, the cylindrical boss 47 projecting to the side opposite to the rocker arm 13 so as to surround the first connecting shaft 24, and an oil path forming member 48 is secured to the rocker arm 13 via a bolt 49.

The oil path forming member 48 is mounted on the rocker arm 13 so as to be in intimate contact with the side face of the rocker arm 13 at a position that is offset from the sliding contact area of said one end part of the first link arm 19 with the rocker arm 13, and a mating hole 50 and a projection 51 are provided on the oil path forming member 48, the mating hole 50 having the boss 47 fitted thereinto, and the projection 51 projecting so as to be fitted into the side face of the rocker arm 13 in an oil-tight manner.

A first oil path 52 communicating with the oil supply path 46 within the fixed support shaft 21 is provided in the first link arm 19, and an annular second oil path 53 communicating with the first oil path 52 is formed between the boss 47 of the first link arm 19 and the first connecting shaft 24. A third oil path 54 having one end that communicates with the second oil path 53 is provided in the oil path forming member 48 so that the other end of the third oil path 54 is disposed within the projection 51, and a fourth oil path 55 providing communication between the third oil path 54 and the annular passages 42 of the hydraulic tappets 12 is provided in the rocker arm 13.

The operation of this embodiment is now explained. Steplessly changing the position of the movable support shaft 22 of the variable lift mechanism 18 enables the amount of lift of the intake valves 7 to be changed steplessly; moreover, since parts at one end of the first and second link arms 19 and 20 are pivotably connected directly to the rocker arm 13, it is possible to reduce the space in which the two link arms 19 and 20 are disposed and make the valve operating system compact, and since the power from the valve operating cam 11 is transmitted directly to the roller 23 of the rocker arm 13, it is possible to ensure that the ability to follow the valve operating cam 11 is excellent.

Furthermore, the rocker arm 13 abuts against the intake valves 7 via the hydraulic tappets 12, the receiving member 41 receiving the hydraulic tappet 12 is slidably fitted into the rocker arm 13, the restricting part 29 facing the receiving member 41 from the side opposite to the hydraulic tappet 12 is provided on the rocker arm 13, and the adjustment screw 44 for adjusting the clearance between the restricting part 29 and the receiving member 41 when the intake valves 7 are in a valve-closed state is screwed into the engine main body 5 so that its position can be adjusted back-and-forth in order to abut against the receiving member 41 when the intake valve 7 is closed.

If there is a clearance between the restricting part 29 of the rocker arm 13 and the receiving member 41 when the intake valves 7 are in a valve-closed state, since a force from the hydraulic tappet 12 to the intake valve 7 in the valve-opening direction does not act until the restricting part 29 abuts against the receiving member 41 after swinging of the rocker arm 13 in the valve-opening direction has started, it is possible, by adjusting the clearance between the restricting part 29 and the receiving member 41 by determining the back-and-forth position of the adjustment screw 44 abutting against the receiving member 41 when the intake valve 7 is in a valve-closed state, to easily adjust the amount of lift of the intake valve 7 with good precision so that there is no variation in the amount of lift of the intake valve 7 even if there are production errors, assembly errors, etc. in each part of the valve operating system. As a result, even when the amount of lift of the intake valve 7 is made very small by the variable lift mechanism 18, the very small amount of lift can be achieved with good precision, which is advantageous for the valve operating system having the variable lift mechanism 18.

Moreover, even if the rocker arm 13 swings by a degree corresponding to the clearance between the restricting part 29 and the receiving member 41 in response to dynamic fluctuations occurring in the camshaft 14, the intake valve 7 is not pushed by the hydraulic tappet 12, and it is possible to prevent the hydraulic tappet 12 from pushing the intake valve 7 while eliminating the need for complicated machining or production control.

Furthermore, since the screw retaining part 45 having the adjustment screw 44 screwed thereinto is provided on the cam holder 15 provided on the engine main body 11 so as to rotatably support the camshaft 14, the rigidity with which the adjustment screw 44 is supported can be increased.

It is necessary to supply oil to the hydraulic tappet 12; the cylindrical boss 47 projecting to the side opposite to the rocker arm 13 so as to surround the first connecting shaft 24 is integrally provided on one end part of the first link arm 19 that is in sliding contact with the side face of the rocker arm 13 and is pivotably connected to the rocker arm 13 via the first connecting shaft 24, the oil path forming member 48 having the mating hole 50 with the boss 47 fitted thereinto is mounted on the rocker arm 13 so as to be in intimate contact with the side face of the rocker arm 13 at a position offset from the sliding contact area of said one end part of the first link arm 19 with the rocker arm 13, the first oil path 52 communicating with the oil supply path 46 coaxially provided within the fixed support shaft 21 is provided in the first link arm 19, the annular second oil path 53 communicating with the first oil path 52 is formed between the boss 47 of the first link arm 19 and the first connecting shaft 24, the third oil path 54 communicating with the second oil path 53 is provided in the oil path forming member 48, and the fourth oil path 55 providing communication between the third oil path 54 and the hydraulic tappet 12 is provided in the rocker arm 13.

In accordance with such an arrangement for the oil paths, the first link arm 19 pivots around the axis of the fixed support shaft 21, it is easy to make the oil supply path 46 within the fixed support shaft 21 communicate with the first oil path 52 within the first link arm 19 while reducing any leakage, it is also easy to form the second oil path 53 communicating with the first oil path 52 between the boss 47 of the first link arm 19 and the first connecting shaft 24 while reducing any leakage, to make the third oil path 54 provided in the oil path forming member 48 pivoting relative to the boss 47 around the axis of the first connecting shaft 24 communicate with the second oil path 53 while reducing any leakage, and to make the fourth oil path 55 provided in the rocker arm 13 so as to communicate with the hydraulic tappet 12 communicate with the third oil path 54 of the oil path forming member 48 swinging together with the rocker arm 13 while reducing any leakage, it is possible to reliably supply oil from the fixed support shaft 21 to the hydraulic tappet 12 by a simple arrangement for the oil paths and, moreover, it is possible to provide lubrication between the first link arm 19 and the first connecting shaft 24 with oil in the second oil path 53.

Although an embodiment of the present invention is explained above, the present invention is not limited to the above-mentioned embodiment, and can be modified in a variety of ways as long as the modifications do not depart from the present invention described in the Claims.

The invention claimed is:

1. An engine valve operating system in which a rocker arm that swings by following a valve operating cam abuts against an engine valve via a hydraulic tappet wherein a receiving member receiving the hydraulic tappet is slidably fitted into the rocker arm, the hydraulic tappet being fitted into the rocker arm, a restricting part is provided so as to face the receiving member from the side opposite to the hydraulic tappet, and an adjustment screw for adjusting a clearance between the restricting part and the receiving member when the engine valve is in a valve-closed state is screwed into an engine main body so that the position of the adjustment screw can be adjusted back-and-forth so as to abut against the receiving member when the engine valve is closed, wherein a screw retaining part having the adjustment screw screwed thereinto is provided on a cam holder provided on the engine main body so as to rotatably support a camshaft having the valve operating cam provided thereon.

2. An engine valve operating system in which a rocker arm that swings by following a valve operating cam abuts against an engine valve via a hydraulic tappet wherein a receiving member receiving the hydraulic tappet is slidably fitted into the rocker arm, the hydraulic tappet being fitted into the rocker arm, a restricting part is provided so as to face the receiving member from the side opposite to the hydraulic tappet, and an adjustment screw for adjusting a clearance between the restricting part and the receiving member when the engine valve is in a valve-closed state is screwed into an engine main body so that the position of the adjustment screw can be adjusted back-and-forth so as to abut against the receiving member when the engine valve is closed, wherein the system comprises a variable lift mechanism that makes the amount of lift of the engine valve steplessly variable, and the variable lift mechanism comprises a first link arm having one end part pivotably connected to the rocker arm and the other end part pivotably supported at a fixed position of the engine main body via a fixed support shaft, and a second link arm having one end part pivotably connected to the rocker arm and the other end part pivotably supported by a movable support shaft that is capable of changing position, a cylindrical boss projecting on the side opposite to the rocker arm so as to surround a connecting shaft is provided integrally with said one end part of the first link arm, the first link arm being in sliding contact with a side face of the rocker arm and pivotably connected to the rocker arm via the connecting shaft, an oil path forming member having a mating hole with the boss fitted thereinto is mounted on the rocker arm so as to be in intimate contact with the side face of the rocker arm at a position offset from a sliding contact area of said one end part of the first link arm with the rocker arm, a first oil path communicating with on oil supply path provided coaxially within the fixed support shaft is provided in the first link arm, an annular second oil path communicating with the first oil path is formed between the boss of the first link arm and the connecting shaft, a third oil path communicating with the second oil path is provided in the oil path forming member, and a fourth oil path providing communication between the third oil path and the hydraulic tappet is provided in the rocker arm.

* * * * *